US009207594B2

(12) United States Patent
Tokuda et al.

(10) Patent No.: US 9,207,594 B2
(45) Date of Patent: Dec. 8, 2015

(54) FIXING DEVICE AND IMAGE FORMING APPARATUS

(71) Applicants: Tetsuo Tokuda, Kanagawa (JP); Naoto Suzuki, Kanagawa (JP); Kohichi Utsunomiya, Kanagawa (JP)

(72) Inventors: Tetsuo Tokuda, Kanagawa (JP); Naoto Suzuki, Kanagawa (JP); Kohichi Utsunomiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/211,741

(22) Filed: Mar. 14, 2014

(65) Prior Publication Data

US 2014/0294461 A1 Oct. 2, 2014

(30) Foreign Application Priority Data

Mar. 29, 2013 (JP) ..... 2013-073008

(51) Int. Cl.
*G03G 15/20* (2006.01)

(52) U.S. Cl.
CPC ..... *G03G 15/2042* (2013.01); *G03G 15/2017* (2013.01); *G03G 15/2053* (2013.01); *G03G 15/2039* (2013.01); *G03G 15/2057* (2013.01); *G03G 15/2078* (2013.01); *G03G 2215/0132* (2013.01); *G03G 2215/2032* (2013.01)

(58) Field of Classification Search
CPC ..... G03G 15/2017; G03G 15/2053; G03G 15/2039; G03G 15/2057; G03G 15/2078
See application file for complete search history.

(56) References Cited

U.S. PATENT DOCUMENTS

| | | | | |
|---|---|---|---|---|
| 7,965,970 | B2 * | 6/2011 | Haseba et al. | 399/329 |
| 2008/0226324 | A1 * | 9/2008 | Baba et al. | 399/69 |
| 2009/0148206 | A1 | 6/2009 | Yoshikawa | |
| 2009/0245897 | A1 | 10/2009 | Seo et al. | |

FOREIGN PATENT DOCUMENTS

| | | |
|---|---|---|
| JP | 2000-030850 | 1/2000 |
| JP | 2001-135470 | 5/2001 |
| JP | 2005-005019 | 1/2005 |
| JP | 2006-119419 | 5/2006 |

(Continued)

OTHER PUBLICATIONS

U.S. Appl. No. 14/204,268, filed Mar. 11, 2014.

(Continued)

*Primary Examiner* — David Gray
*Assistant Examiner* — Michael Harrison
(74) *Attorney, Agent, or Firm* — Oblon, McClelland, Maier & Neustadt, L.L.P.

(57) ABSTRACT

A fixing device includes an exciting coil and a heat generator disposed opposite the exciting coil. The heat generator includes a heat generation layer disposed opposite the exciting coil to generate heat by a magnetic flux from the exciting coil and a temperature sensitive magnetic body disposed opposite the exciting coil via the heat generation layer to obtain and lose magnetism at a temperature defined by a Curie temperature by composition adjustment to selectively create a heating region and a non-heating region of the heat generation layer. A degausser is disposed opposite the heat generator and made of a non-magnetic material having an electrical resistivity smaller than that of the temperature sensitive magnetic body. A holder contacting and supporting the degausser is disposed inboard from a lateral edge of the degausser and outboard from a lateral end of the exciting coil in a longitudinal direction of the degausser.

20 Claims, 4 Drawing Sheets

(56) References Cited

FOREIGN PATENT DOCUMENTS

| | | |
|---|---|---|
| JP | 2007-178477 | 7/2007 |
| JP | 2007-212988 | 8/2007 |
| JP | 2009-139674 | 6/2009 |
| JP | 2009-230070 | 10/2009 |
| JP | 2011-039242 | 2/2011 |
| JP | 2011-227293 | 11/2011 |
| WO | WO2005/038533 A1 | 4/2005 |

OTHER PUBLICATIONS

U.S. Appl. No. 14/204,268, filed Mar. 11, 2014, Yamano, et al.

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2013-073008, filed on Mar. 29, 2013, in the Japanese Patent Office, the entire disclosure of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

The fixing device may employ an induction heater to heat the recording medium quickly. For example, the induction heater heats a fixing rotary body, such as a fixing roller and a fixing belt, pressingly contacted by a pressure roller to form a fixing nip therebetween. As the recording medium bearing the toner image is conveyed through the fixing nip, the fixing rotary body and the pressure roller apply heat and pressure to the recording medium, thus melting and fixing the toner image on the recording medium. Since the fixing rotary body incorporates a heat generation layer that generates heat by a magnetic flux generated by an exciting coil of the induction heater, the fixing rotary body is heated to a desired fixing temperature to fix the toner image on the recording medium quickly.

However, the heat generation layer is thin and therefore may cause temperature variation of the fixing rotary body in an axial direction thereof. For example, after a plurality of small recording media is conveyed over the fixing rotary body continuously, both lateral ends of the fixing rotary body in the axial direction thereof may overheat because the small recording media are not conveyed over both lateral ends of the fixing rotary body and therefore do not draw heat therefrom. Accordingly, the temperature of the fixing rotary body varies in the axial direction thereof. Consequently, as a large recording medium is conveyed over the fixing rotary body immediately after conveyance of the small recording media, temperature variation of the fixing rotary body may vary gloss of a toner image on the large recording medium.

In order to eliminate temperature variation of the fixing rotary body, two solutions are proposed.

As a first solution, a self temperature control to offset a magnetic flux with a repulsive magnetic flux may be used. For example, a magnetic shunt alloy may be interposed between the heat generation layer and a metal plate serving as a degausser. When the temperature of the magnetic shunt alloy reaches a Curie temperature, a magnetic flux from the exciting coil penetrates the metal plate, allowing the metal plate to generate a repulsive magnetic flux that offsets the magnetic flux from the exciting coil.

As a second solution to eliminate temperature variation of the fixing rotary body, a magnetic flux shield may be interposed between the exciting coil and the fixing rotary body incorporating a heat generator. The magnetic flux shield is movable in a circumferential direction of the fixing rotary body and has a shape that adjusts an amount of magnetic fluxes directed to the fixing rotary body from the exciting coil.

However, the magnetic flux shield interposed between the exciting coil and the heat generator of the fixing rotary body may occupy a substantial space that increases an interval between the exciting coil and the heat generator, degrading heat generation efficiency of the heat generator. The increased interval between the exciting coil and the heat generator may increase an interval between the exciting coil and the magnetic flux shield, degrading degaussing efficiency of the magnetic flux shield. The degraded heat generation efficiency may make it longer for the fixing rotary body to be warmed up to a predetermined fixing temperature.

Further, the magnetic flux shield movable in the circumferential direction of the fixing rotary body may complicate the configuration of the fixing device, upsizing the fixing device.

Additionally, in order to suppress overheating of both lateral ends of the fixing rotary body in the axial direction thereof where the small recording media are not conveyed, it may take a substantial time to detect the temperature of both lateral ends of the fixing rotary body in the axial direction thereof and move the magnetic flux shield in the circumferential direction of the fixing rotary body.

SUMMARY

This specification describes below an improved fixing device. In one exemplary embodiment, the fixing device includes an exciting coil to generate a magnetic flux and a heat generator disposed opposite the exciting coil. The heat generator includes a heat generation layer disposed opposite the exciting coil to generate heat by the magnetic flux from the exciting coil and a temperature sensitive magnetic body disposed opposite the exciting coil via the heat generation layer. The temperature sensitive magnetic body obtains and loses magnetism at a temperature defined by a Curie temperature by composition adjustment to selectively create a heating region and a non-heating region of the heat generation layer. A degausser is disposed opposite the heat generator and made of a non-magnetic material having an electrical resistivity smaller than an electrical resistivity of the temperature sensitive magnetic body. A holder contacting and supporting the degausser is disposed inboard from a lateral edge of the degausser and outboard from a lateral end of the exciting coil in a longitudinal direction of the degausser.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
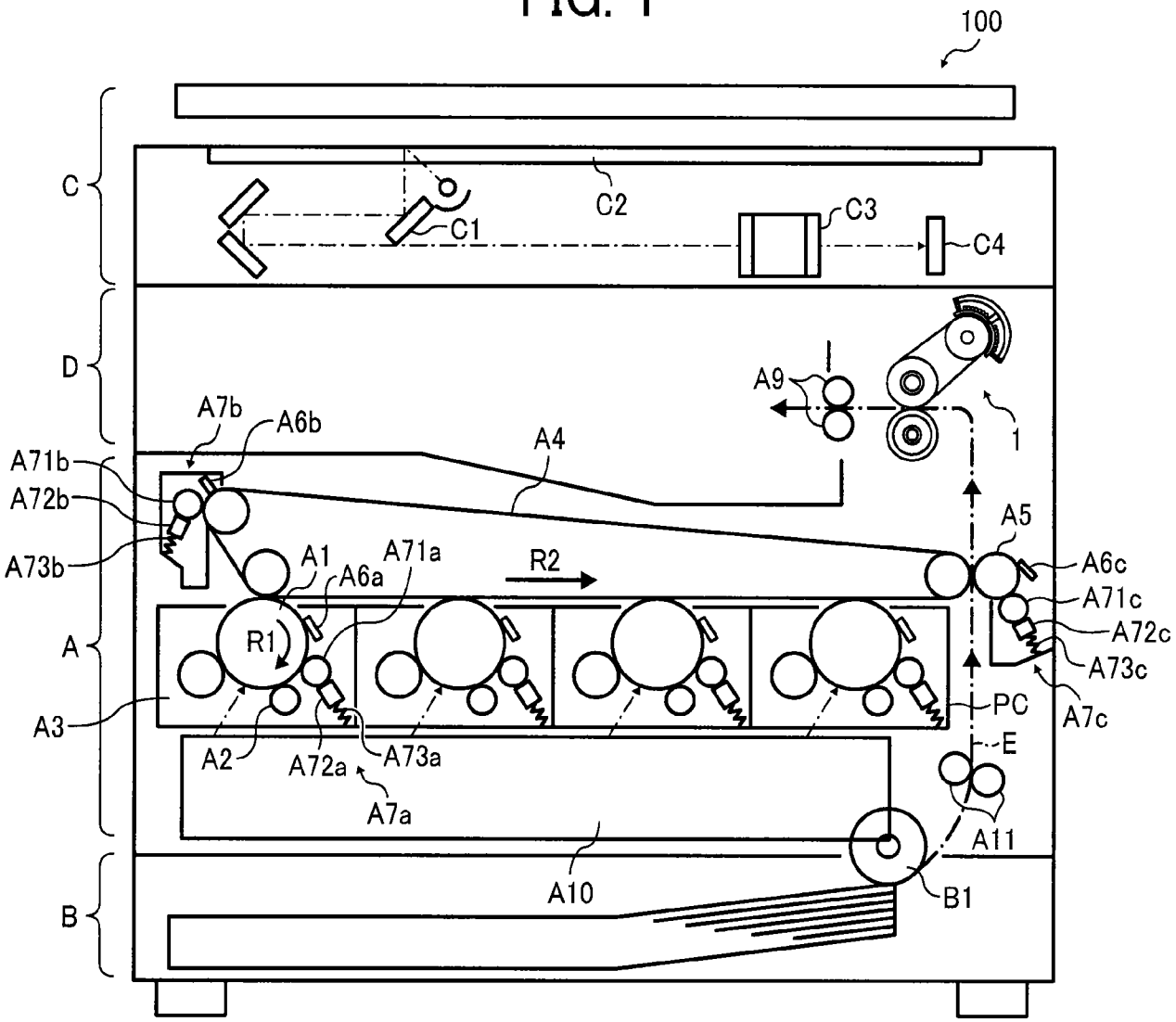
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present invention is explained.

FIG. 1 is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a color copier that forms color and monochrome toner images on recording media by electrophotography.

As shown in FIG. 1, the image forming apparatus 100 is a compact copier having an internal output tray accommodated inside a body of the image forming apparatus 100. The image forming apparatus 100 includes an image forming device A, situated at substantially a center of the image forming apparatus 100 in a vertical direction, that forms a toner image on a recording medium. Below the image forming device A is a sheet feeder B that feeds the recording medium to the image forming device A. Optionally, another sheet feeder may be located below the sheet feeder B.

Above the image forming device A is an internal output tray D that receives the recording medium bearing the toner image. Above the internal output tray D is a scanner C that reads an image on an original. A recording medium conveyance path E indicated by the dotted line extends from the sheet feeder B to the internal output tray D.

A detailed description is now given of a construction of the image forming device A.

The image forming device A includes four drum-shaped photoconductors A1 each of which is surrounded by components for forming a toner image. Taking the leftmost photoconductor A1 as an example, the photoconductor A1 rotatable in a rotation direction R1 is surrounded by a charger A2 that charges an outer circumferential surface of the photoconductor A1, an exposure device A10 that emits a laser beam onto the charged outer circumferential surface of the photoconductor A1 according to image data created by the scanner C, thus forming an electrostatic latent image on the photoconductor A1, and a development device A3 that develops the electrostatic latent image formed on the photoconductor A1 into a toner image.

In proximity to the four photoconductors A1 are an intermediate transfer belt A4 serving as an intermediate transferor and a secondary transferor A5. The toner images formed on the four photoconductors A1 are primarily transferred onto the intermediate transfer belt A4 such that the toner images are superimposed on a same position on the intermediate transfer belt A4 to form a color toner image thereon. The color toner image is secondarily transferred from the intermediate transfer belt A4 onto a recording medium conveyed from the sheet feeder B by the secondary transferor A5.

A cleaner A6*a* is disposed opposite the photoconductor A1 to remove residual toner failed to be transferred onto the intermediate transfer belt A4 and therefore remaining on the photoconductor A1 therefrom. A cleaner A6*b* is disposed opposite the intermediate transfer belt A4 to remove residual toner failed to be transferred onto the recording medium and therefore remaining on the intermediate transfer belt A4 therefrom. A cleaner A6*c* is disposed opposite the secondary transferor A5 to clean the secondary transferor A5. In proximity to the cleaner A6*a* is a lubricant applicator A7*a* that applies a lubricant onto the photoconductor A1 to decrease the friction coefficient of the outer circumferential surface of the photoconductor A1. Similarly, in proximity to the cleaner A6*b* is a lubricant applicator A1*b* that applies a lubricant onto the intermediate transfer belt A4 to decrease the friction coefficient of an outer circumferential surface of the intermediate transfer belt A4. In proximity to the cleaner A6*c* is a lubricant applicator A7*c* that applies a lubricant onto the secondary transferor A5 to decrease the frictional coefficient of an outer circumferential surface of the secondary transferor A5.

Downstream from the secondary transferor A5 on the recording medium conveyance path E in a recording medium conveyance direction is a fixing device 1 that fixes the color toner image secondarily transferred from the intermediate transfer belt A4 onto the recording medium thereon.

In order to facilitate maintenance, the photoconductor A1, the charger A2, the development device A3, the cleaner A6*a*, and the lubricant applicator A7*a* are integrated into a unit, that is, a process cartridge PC, detachably attached to the image forming apparatus 100. Similarly, the cleaner A6*b* and the lubricant applicator A1*b* are integrated into a unit detachably attached to the intermediate transfer belt A4. The cleaner A6*c*, the lubricant applicator A7*c*, and a secondary transfer roller used as the secondary transferor A5 are integrated into a unit detachably attached to the image forming apparatus 100. The recording medium bearing the fixed color toner image discharged from the fixing device 1 is discharged by an output roller pair A9 onto the internal output tray D which stocks the recording medium.

A detailed description is now given of conveyance of the recording medium to the image forming device A.

The sheet feeder B loads a plurality of new recording media and includes a feed roller B1 and a paper tray. As the feed roller B1 rotates, the feed roller B1 picks up and feeds an uppermost recording medium from the plurality of recording media loaded on the paper tray toward a registration roller pair A11. The registration roller pair A11 stops rotation temporarily to halt the recording medium conveyed from the feed roller B1 and resumes rotation to feed the recording medium such that a leading edge of the recording medium reaches a secondary transfer nip formed between the intermediate transfer belt A4 and the secondary transferor A5 at a time when the color toner image formed on the intermediate transfer belt A4 reaches the secondary transfer nip.

A description is provided of an image forming operation performed by the image forming apparatus 100 described above to form a color toner image on a recording medium.

The scanner C includes an exposure glass C2, a carriage C1, a lens C3, and a charge-coupled device (CCD) C4. As the carriage C1 constructed of a light source and mirrors moves back and forth, the light source irradiates an original placed on the exposure glass C2 with light. The light reflected by the original is deflected by the mirrors of the carriage C1 into the lens C3 and enters the CCD C4 situated downstream from the lens C3 in a light travel direction. Thus, an image on the original is read into an image signal by the CCD C4.

The image signal is digitalized and subject to image processing. Based on the processed signal, a laser diode of the exposure device A10 emits light onto the outer circumferential surface of the photoconductor A1, forming an electrostatic latent image thereon. For example, the light emitted from the laser diode reaches the photoconductor A1 through a polygon mirror and a lens.

The charger A2 includes a charging member (e.g., a charging roller) and a biasing member that biases the charging member against the photoconductor A1 with predetermined pressure. The charging member is constructed of a conductive shaft and a conductive elastic layer coating the conductive shaft. A voltage applicator applies a predetermined voltage to a gap between the conductive elastic layer of the charging member and the photoconductor A1 through the conductive shaft, thus charging the outer circumferential surface of the photoconductor A1.

The development device A3 includes an agitation screw, a development roller, and a development doctor. A developer containing toner, after being agitated sufficiently by the agitation screw, adheres to the development roller magnetically. The development doctor levels the developer on the development roller into a thin layer. The leveled developer moves to the electrostatic latent image formed on the photoconductor A1, visualizing the electrostatic latent image as a toner image.

A primary transfer roller electrically adheres the toner image onto the intermediate transfer belt A4. Residual developer, that is, residual toner, failed to be transferred onto the intermediate transfer belt A4 and therefore remaining on the photoconductor A1 is removed from the photoconductor A1 by the cleaner A6*a*. The lubricant applicator A1*a* includes a lubricant application roller A71*a* constructed of a metal shaft and a brush wound around the metal shaft.

The lubricant application roller A71*a* biases against a solid lubricant A72*a* under its weight. A biasing member A73*a* biases the solid lubricant A72*a* against the lubricant application roller A71*a*. The lubricant application roller A71*a*, as it rotates, scrapes fine powder off the solid lubricant A72*a* and applies the fine powder on the outer circumferential surface of the photoconductor A1. For example, the fine powder of the solid lubricant A72*a* is applied on substantially the entire outer circumferential surface of the photoconductor A1 that is greater than a cleaning area on the photoconductor A1 where the cleaner A6*a* cleans the photoconductor A1. The cleaning area on the photoconductor A1 is determined based on cleaning performance of the cleaner A6*a* or the like. Conversely, the solid lubricant A72*a* is applied to the entire area on the photoconductor A1 where the cleaning blade contacts the photoconductor A1.

The lubricant applicator A7*b* and the cleaner A6*b* are integrated into a transfer cartridge detachably attached to the image forming apparatus 100. A biasing member A73*b* biases a solid lubricant A72*b* against a lubricant application roller A71*b* (e.g., a brush roller) with predetermined pressure. The lubricant application roller A71*b*, as it rotates, scrapes fine powder off the solid lubricant A72*b* and applies the fine powder on the outer circumferential surface of the intermediate transfer belt A4. Upstream from the lubricant applicator A7*b* in a rotation direction R2 of the intermediate transfer belt A4 is the cleaner A6*b* incorporating a brush roller and a cleaning blade that clean the intermediate transfer belt A4.

For example, the brush roller rotates in a direction identical to the rotation direction R2 of the intermediate transfer belt A4 to disperse a foreign substance from the outer circumferential surface of the intermediate transfer belt A4. The cleaning blade contacts the intermediate transfer belt A4 with predetermined angle and pressure to remove residual toner failed to be transferred onto the recording medium and therefore remaining on the intermediate transfer belt A4 therefrom.

Similarly, the cleaner A6*c* and the secondary transferor A5 are integrated into a transfer cartridge detachably attached to the image forming apparatus 100. The cleaner A6*c* removes residual toner remaining on the secondary transferor A5 therefrom. The lubricant applicator A7*c* includes a biasing member A73*c* that biases a solid lubricant A72*c* against a lubricant application roller A71*c* so that the lubricant application roller A71*c* applies fine powder scraped off the solid lubricant A72*c* onto the secondary transferor A5.

Figure 2:
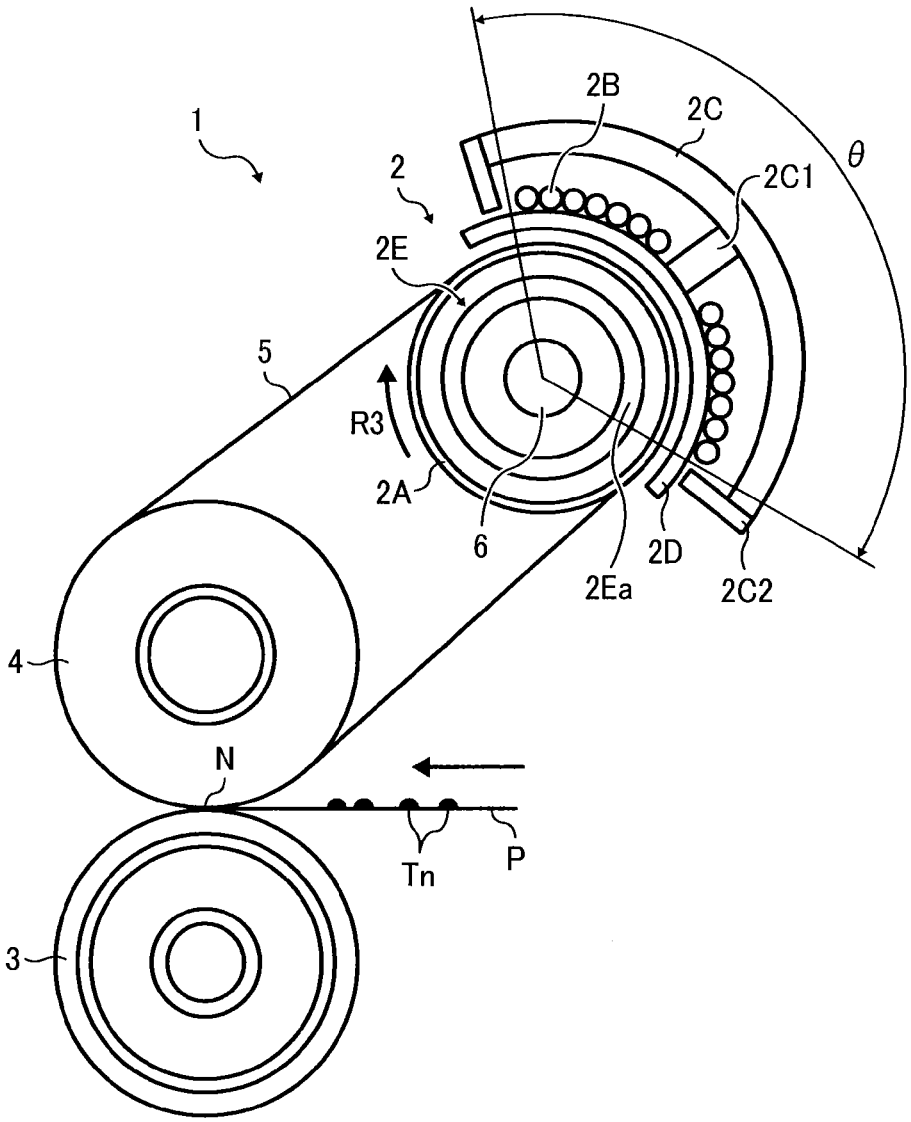
FIG. 2 is a schematic vertical sectional view of a fixing device incorporated in the image forming apparatus shown in FIG. 1.

With reference to FIG. 2, a description is provided of a construction of the fixing device 1 incorporated in the image forming apparatus 100 described above.

FIG. 2 is a vertical sectional view of the fixing device 1. As shown in FIG. 2, the fixing device 1 (e.g., a fuser) employs a belt fixing method using a fixing belt 5 looped over a fixing roller 4 and a heating roller 2A. The fixing roller 4 is disposed opposite a pressure roller 3 pressed against the fixing roller 4. A heating assembly 2 includes the hollow heating roller 2A serving as a heat generator rotatable in a rotation direction R3, a coil support 2D disposed opposite the heating roller 2A via the fixing belt 5, an exciting coil 2B supported by the coil support 2D and disposed opposite the fixing belt 5 via the coil support 2D, an arc core 2C disposed opposite the fixing belt 5 via the exciting coil 2B and the coil support 2D, and a degausser 2E disposed inside the hollow heating roller 2A.

Figure 3:
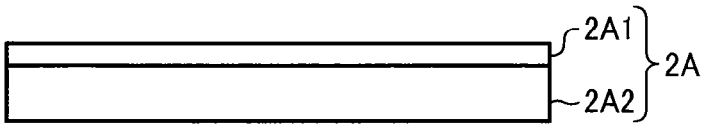
FIG. 3 is a sectional view of a heating roller incorporated in the fixing device shown in FIG. 2.

With reference to FIG. 3, a detailed description is now given of a construction of the heating roller 2A.

FIG. 3 is a sectional view of the heating roller 2A. As shown in FIG. 3, the heating roller 2A includes a heat generation layer 2A1 and a temperature sensitive magnetic body 2A2 (e.g., a temperature sensitive magnetic layer) disposed opposite the exciting coil 2B via the heat generation layer 2A1. The heat generation layer 2A1 generates heat by induction heating as it receives a magnetic flux from the exciting coil 2B. The heat generation layer 2A1 coats a surface of the temperature sensitive magnetic body 2A2 by conductive plating such as copper plating, facilitating production of an eddy current and heat generation of the heat generation layer 2A1.

That is, the heat generation layer 2A1 includes a surface treated with conductive plating.

The temperature sensitive magnetic body 2A2 is made of a magnetic shunt alloy. The magnetic shunt alloy is a magnetic material of which composition is adjusted such that the magnetic shunt alloy has a Curie temperature in a range of from about 100 degrees centigrade to about 300 degrees centigrade, for example, a magnetic shunt alloy material containing iron, nickel, or the like. The temperature sensitive magnetic body 2A2 obtains and loses magnetism below and above the Curie temperature. As the temperature sensitive magnetic body 2A2 obtains and loses magnetism, the temperature sensitive magnetic body 2A2 adjusts penetration of a magnetic flux through the heat generation layer 2A1, selectively creating a heating region and a non-heating region of the heat generation layer 2A1. For example, the heating region corresponds to a conveyance region of the fixing belt 5 where a recording medium P is conveyed, that is, a center span of the fixing belt 5 in an axial direction thereof. The non-heating region corresponds to a non-conveyance region of the fixing belt 5 where a recording medium P is not conveyed, that is, each lateral end span of the fixing belt 5 in the axial direction thereof.

According to this exemplary embodiment, the temperature sensitive magnetic body 2A2 is formed in a roller. Alternatively, the temperature sensitive magnetic body 2A2 may be formed in a film, an endless belt, or the like.

Accordingly, since the heating roller 2A incorporates the heat generation layer 2A1, the fixing belt 5 is constructed of a base layer made of polyimide resin. Although the fixing belt 5 does not incorporate a heat generation layer, the fixing belt 5 is heated to a predetermined temperature by the heating roller 2A.

Figure 4:
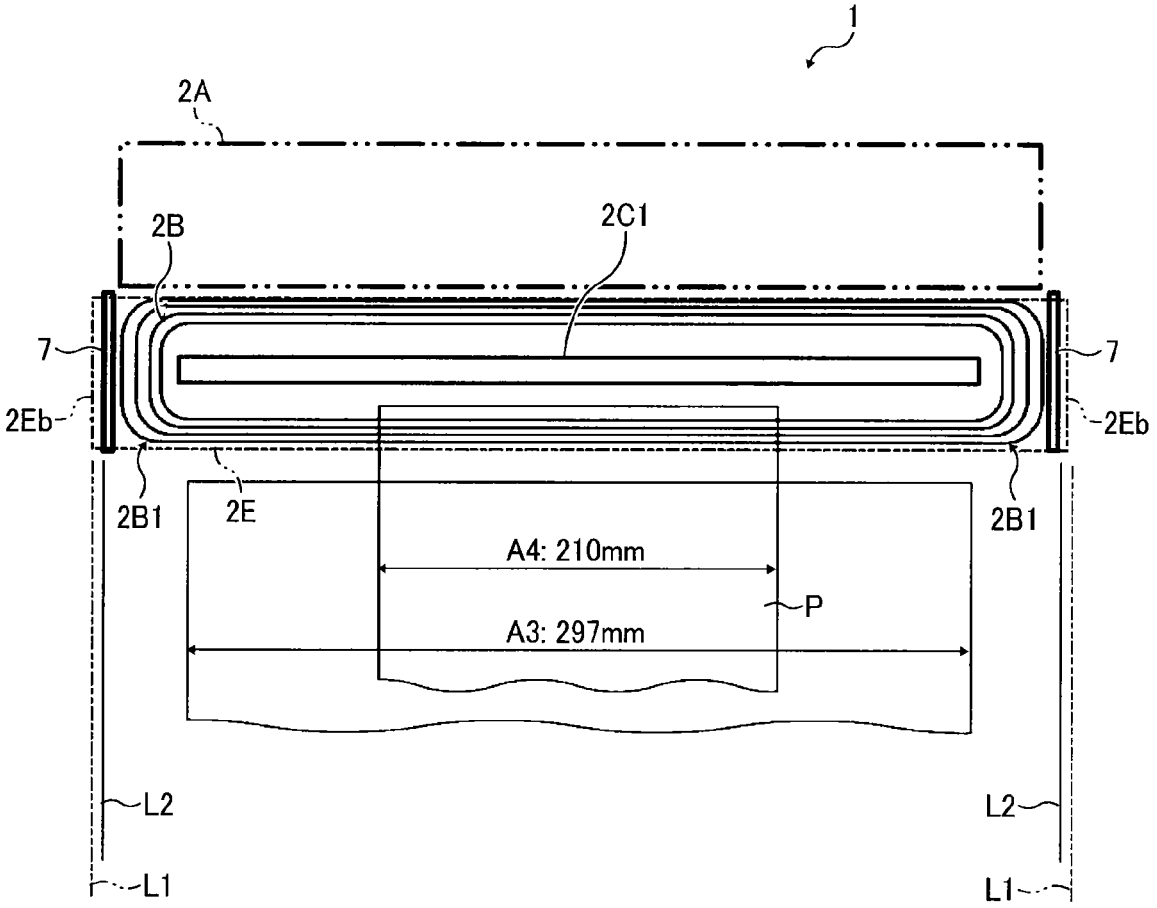
FIG. 4 is a development of an exciting coil and the heating roller incorporated in the fixing device shown in FIG. 2.

With reference to FIG. 4, a detailed description is now given of a configuration of the exciting coil 2B.

FIG. 4 is a development of the exciting coil 2B and the heating roller 2A. The exciting coil 2B includes folded lateral ends in a longitudinal direction thereof parallel to an axial direction of the heating roller 2A, that is, turn portions 2B1 where wiring of the exciting coil 2B is turned, and extensions contiguously extending from the turn portions 2B1, respectively. The length of the exciting coil 2B including the extensions is equivalent to or greater than the width of a large recording medium P (e.g., the width of an A3 size recording medium of 297 mm) in the axial direction of the heating roller 2A. FIG. 4 illustrates the width of a large, A3 size recording medium P of 297 mm and the width of a small, A4 size recording medium P of 210 mm.

A detailed description is now given of a configuration of the arc core 2C.

As shown in FIG. 2, the arc core 2C includes a center core 2C1 situated at a center of the arc core 2C in a circumferential direction thereof and side cores 2C2 situated at both ends of the arc core 2C in the circumferential direction thereof. The exciting coil 2B is wound around the center core 2C1 as shown in FIG. 4.

A detailed description is now given of a configuration of the degausser 2E.

The degausser 2E is a non-magnetic conductor made of aluminum or an alloy of aluminum that has an electrical resistivity smaller than that of the temperature sensitive magnetic body 2A2 of the heating roller 2A. As shown in FIG. 2, the degausser 2E is disposed opposite an outer circumferential surface of a shaft 6 rotatably mounting the heating roller 2A. The degausser 2E includes an arch 2Ea having a center angle θ greater than an angle defined by a circumferential span of the exciting coil 2B disposed opposite the degausser 2E. When the temperature sensitive magnetic body 2A2 of the heating roller 2A selectively creates the heating region and the non-heating region of the heat generation layer 2A1, a magnetic flux reaching the degausser 2E generates an eddy current in the degausser 2E that generates a repulsive magnetic flux, preventing the magnetic flux penetrating through the heating roller 2A from penetrating through the shaft 6 disposed opposite the heating roller 2A via the degausser 2E. It is to be noted that, although the degausser 2E is disposed inside the heating roller 2A as shown in FIG. 2, FIG. 4 illustrates a development of the degausser 2E.

An inverter connected to the exciting coil 2B drives the exciting coil 2B at high frequency, producing a high frequency magnetic field, that is, a high frequency magnetic flux. The high frequency magnetic field moves an eddy current through the heat generation layer 2A1 of the heating roller 2A, thus increasing the temperature of the heating roller 2A. As shown in FIG. 2, as a recording medium P bearing a toner image Tn is conveyed through a fixing nip N formed between the pressure roller 3 and the fixing belt 5 looped over the fixing roller 4 and the heating roller 2A such that the toner image Tn faces the fixing belt 5, the fixing belt 5 heated by the heating roller 2A and the pressure roller 3 apply heat and pressure to the recording medium P, melting and fixing the toner image Tn on the recording medium P.

A detailed description is now given of a configuration of the pressure roller 3.

The pressure roller 3 serves as a driving roller for driving the fixing belt 5. The pressure roller 3 is pressed against the fixing roller 4 via the fixing belt 5 to form the fixing nip N between the pressure roller 3 and the fixing belt 5. As the recording medium P bearing the toner image Tn is conveyed through the fixing nip N, the pressure roller 3 drives and rotates the fixing belt 5 by friction therebetween. According to this exemplary embodiment, a driver is connected to the pressure roller 3. Alternatively, the driver may be connected to the fixing roller 4 or the heating roller 2A so that the fixing roller 4 or the heating roller 2A drives and rotates the fixing belt 5 by friction therebetween.

Figure 5:
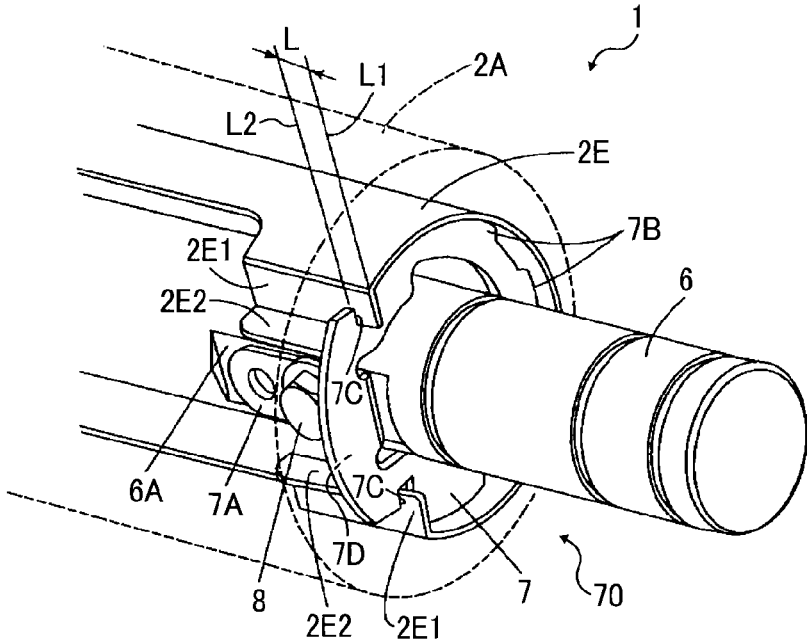
FIG. 5 is a partial perspective view of the fixing device shown in FIG. 2 illustrating one lateral end of the heating roller in an axial direction thereof.

With reference to FIG. 5, a description is provided of a construction of a support assembly that supports the degausser 2E incorporated in the fixing device 1 having the construction described above.

The support assembly for supporting the degausser 2E is constructed of components that are not susceptible to magnetic fluxes from the exciting coil 2B and therefore are immune from being heated.

FIG. 5 is a partial perspective view of the fixing device 1 illustrating one lateral end of the heating roller 2A in the axial direction thereof. As shown in FIG. 5, a support assembly 70 for supporting the degausser 2E includes the shaft 6 that rotatably supports the heating roller 2A of the heating assembly 2 and a holder 7 that holds the degausser 2E with respect to the shaft 6 such that the degausser 2E is disposed opposite the shaft 6. The shaft 6, mounted on a housing of the fixing device 1, includes a flat portion 6A constituting a part of the shaft 6 extending in an axial direction thereof. The holder 7 is fastened to the flat portion 6A.

The holder 7 is a plate inserted into the substantially tubular or arcuate degausser 2E at each lateral end of the degausser 2E in a width direction thereof, that is, a longitudinal direction, parallel to the axial direction of the shaft 6. A part of the holder 7 in a circumferential direction thereof is bent into a mount tab 7A extending in the axial direction of the shaft 6 and fastened to the flat portion 6A of the shaft 6 with a bolt 8, thus being mounted on the flat portion 6A. Alternatively, the shaft 6 may include a slot capped with a mounting plate that mounts the mount tab 7A of the holder 7.

With reference to FIGS. 4 and 5, a description is provided of a relation between the holder 7 and the exciting coil 2B.

FIG. 4 illustrates the degausser 2E in the dotted line; FIG. 5 illustrates the degausser 2E in the solid line. As shown in FIG. 4, a lateral edge 2Eb of the degausser 2E in the longitudinal direction thereof is situated on a line L1 disposed outboard from the turn portion 2B1 of the exciting coil 2B in the axial direction of the shaft 6. Conversely, the holder 7 is disposed inboard from the lateral edge 2Eb of the degausser 2E in the axial direction of the shaft 6 as shown in FIG. 4 and situated in a reentrant L defined by the line L1 and a line L2 as shown in FIG. 5. Additionally, the holder 7 is situated on the line L2 disposed outboard from the turn portion 2B1 of the exciting coil 2B in the axial direction of the shaft 6 as shown in FIG. 4. That is, each holder 7 is interposed between the lateral edge 2Eb of the degausser 2E and the turn portion 2B1 of the exciting coil 2B in the axial direction of the shaft 6.

With reference to FIG. 5, a description is provided of mounting of the degausser 2E on the holder 7.

As shown in FIG. 5, a part of the degausser 2E in a circumferential direction thereof that is disposed opposite each lateral end of the shaft 6 in the axial direction thereof is bent at a right angle into an engagement tab 2E1. A part of the engagement tab 2E1 is bent at a right angle into a location tab 2E2. That is, the location tab 2E2 extends from the engagement tab 2E1 at the right angle. The length of the location tab 2E2 is smaller than that of the engagement tab 2E1 in the longitudinal direction of the degausser 2E. The holder 7 engages the reentrant L defined by the engagement tab 2E1 and the location tab 2E2.

The holder 7 includes a plurality of projections 7B disposed opposite and in contact with an inner circumferential surface of the degausser 2E, retaining the shape of the degausser 2E that corresponds to an inner circumferential surface of the heating roller 2A. A part of the holder 7 in a circumferential direction thereof is formed into a notch 7C disposed opposite and engaging the engagement tab 2E1 of the degausser 2E to hold the degausser 2E, thus retaining the shape of the degausser 2E. For example, the notch 7C extends inward from an outer circumferential surface of the holder 7. As shown in FIG. 5, the degausser 2E has two engagement tabs 2E1 and two location tabs 2E2; the holder 7 has two notches 7C. The degausser 2E is curved to correspond to the inner circumferential surface of the heating roller 2A. Even if the degausser 2E is heated as the exciting coil 2B heats the heating roller 2A, the notches 7C of the holder 7 that engage the engagement tabs 2E1 of the degausser 2E prevent thermal, radial deformation or expansion of the degausser 2E. The location tabs 2E2 contacting an inboard face 7D of the holder 7 disposed opposite the location tabs 2E2 also serve as a retainer that prevents the degausser 2E from slipping off the holder 7.

The holder 7 retains the shape of the degausser 2E that corresponds to the inner circumferential surface of the heating roller 2A and allows the degausser 2E to be situated close to the inner circumferential surface of the heating roller 2A. Accordingly, the degausser 2E is disposed opposite the exciting coil 2B in cross-section in FIG. 2 with an interval in a range of from about 4.2 mm to about 8.2 mm. Consequently, the degausser 2E improves its degaussing efficiency while enhancing heat generation efficiency of the heating roller 2A.

The holder 7 supports the degausser 2E stationarily inside the heating roller 2A. Accordingly, it is not necessary to allocate a space where the degausser 2E moves in the axial direction of the shaft 6, downsizing the heating roller 2A and the fixing device 1. Since the heating roller 2A incorporates the heat generation layer 2A1 as shown in FIG. 3, the fixing belt 5 does not incorporate a heat generation layer, simplifying the construction of the fixing belt 5 at reduced manufacturing costs.

Even when the exciting coil 2B generates a magnetic flux to heat the heating roller 2A by electromagnetic induction, the magnetic flux does not reach the holder 7 that supports the degausser 2E. Accordingly, the holder 7 is not heated and therefore is immune from thermal deformation that may adversely affect the degausser 2E and heat conduction from the holder 7 to the shaft 6. Consequently, the holder 7 retains the shape of the degausser 2E and supports the degausser 2E precisely, suppressing degradation in degaussing efficiency of the degausser 2E.

As shown in FIG. 5, a part of the degausser 2E, that is, the engagement tabs 2E1 of the degausser 2E, engages the holder 7, thus preventing radial deformation or expansion of the degausser 2E. Accordingly, the interval between the degausser 2E and the exciting coil 2B does not change, thus suppressing degradation in heating efficiency of the heating roller 2A and degaussing efficiency of the degausser 2E.

Figure 6:
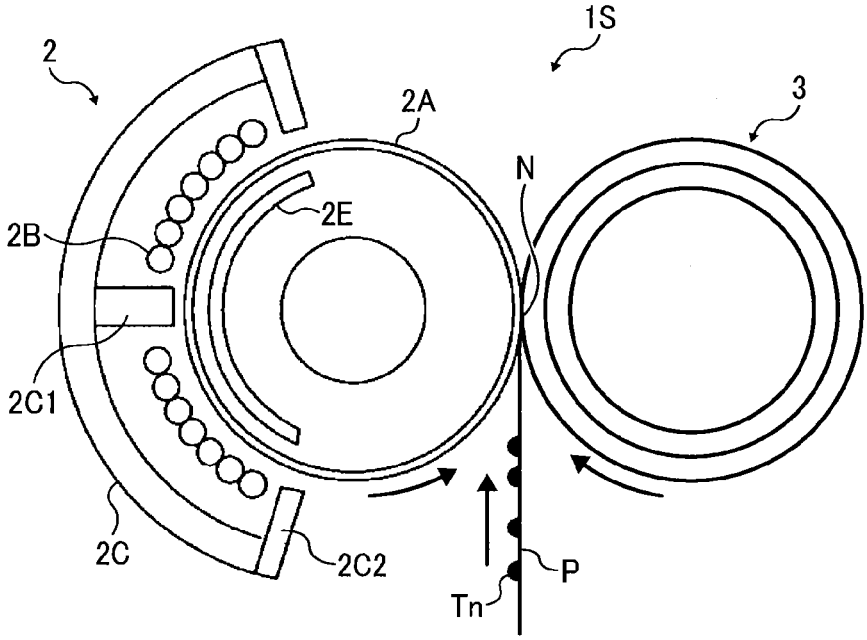
FIG. 6 is a vertical sectional view of a fixing device according to another exemplary embodiment of the present invention.

With reference to FIG. 6, a description is provided of a construction of a fixing device 1S according to another exemplary embodiment.

FIG. 6 is a vertical sectional view of the fixing device 1S. Unlike the fixing device 1 depicted in FIG. 2 that employs a belt fixing method using the fixing belt 5 to come into contact with and heat the toner image Tn on the recording medium P, the fixing device 1S depicted in FIG. 6 employs a roller fixing method using the heating roller 2A to come into contact with and heat the toner image Tn on the recording medium P. For example, the pressure roller 3 is pressed against the heating roller 2A to form the fixing nip N therebetween through which the recording medium P bearing the toner image Tn is conveyed.

As shown in FIG. 6, the exciting coil 2B is disposed opposite an outer circumferential surface of the heating roller 2A; the degausser 2E is disposed opposite the inner circumferential surface of the heating roller 2A. The heating roller 2A has the construction shown in FIG. 3, thus serving as a heat generator. Since the heating roller 2A is a rotary body rotatable counterclockwise in FIG. 6, the degausser 2E is supported by the holder 7 depicted in FIGS. 4 and 5.

Alternatively, the heat generation layer 2A1 may be formed in a belt or a film wound around the heating roller 2A. In this case, the heat generation layer 2A1 may pressingly contact the temperature sensitive magnetic body 2A2 of the heating roller 2A at a position in proximity to the fixing nip N where the heat generation layer 2A1 sandwiches the recording medium P together with the pressure roller 3.

A description is provided of advantages of the fixing devices 1 and 1S.

As shown in FIGS. 2 to 6, the fixing devices 1 and 1S include the exciting coil 2B, the heating roller 2A serving as a heat generator or a heating rotary body including the heat generation layer 2A1 disposed opposite the exciting coil 2B and the temperature sensitive magnetic body 2A2 (e.g., a temperature sensitive magnetic layer) disposed opposite the exciting coil 2B via the heat generation layer 2A1, and the degausser 2E disposed opposite the exciting coil 2B via the heat generation layer 2A1 and the temperature sensitive magnetic body 2A2.

The exciting coil 2B generates a magnetic flux. The heat generation layer 2A1 generates heat by the magnetic flux from the exciting coil 2B. The temperature sensitive magnetic body 2A2 obtains and loses magnetism at a temperature defined by a Curie temperature by composition adjustment. The degausser 2E is made of a non-magnetic material having an electrical resistivity smaller than that of the temperature sensitive magnetic body 2A2. The temperature sensitive magnetic body 2A2 obtains and loses magnetism to selectively create the heating region and the non-heating region of the heat generation layer 2A1. The fixing devices 1 and 1S further include the shaft 6 supporting the heating roller 2A and the holder 7 mounted on the shaft 6 to hold the degausser 2E such that the degausser 2E is disposed opposite the shaft 6. The lateral edge 2Eb of the degausser 2E is situated outboard from the lateral end, that is, the turn portion 2B1, of the exciting coil 2B in the axial direction of the shaft 6. The holder 7 includes a plate disposed inboard from the lateral edge 2Eb of the degausser 2E and outboard from the turn portion 2B1 of the exciting coil 2B in the axial direction of the shaft 6. The holder 7 contacts the inner circumferential surface of the degausser 2E.

As shown in FIG. 5, the holder 7 mounts the degausser 2E. Accordingly, it is not necessary to allocate a space where the degausser 2E moves in the axial direction of the shaft 6, downsizing the fixing devices 1 and 1S.

As shown in FIG. 4, since the holder 7 holding the degausser 2E is situated inboard from the lateral edge 2Eb of the degausser 2E in the axial direction of the shaft 6, the degausser 2E prevents the holder 7 from being adversely affected by a magnetic flux from the exciting coil 2B. Accordingly, the holder 7 is not heated and therefore is immune from thermal deformation or expansion that may degrade its positioning of the degausser 2E, thus suppressing degradation in heat generation efficiency of the heating roller 2A and degaussing efficiency of the degausser 2E.

Additionally, the holder 7 may not overheat by heat conduction from the heating roller 2A. For example, if the holder 7 is situated outboard from the lateral edge 2Eb of the degausser 2E in the longitudinal direction thereof, the holder 7 is subject to heat conduction from the heating roller 2A, resulting in overheating of both lateral ends of the fixing belt 5 in the axial direction thereof. To address this circumstance, according to the exemplary embodiments described above, the holder 7 is situated inboard from the lateral edge 2Eb of the degausser 2E in the longitudinal direction thereof.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

an exciting coil to generate a magnetic flux;

a heat generator disposed opposite the exciting coil and including:

a heat generation layer disposed opposite the exciting coil to generate heat by the magnetic flux from the exciting coil; and a temperature sensitive magnetic body disposed opposite the exciting coil via the heat generation layer, the temperature sensitive magnetic body to obtain and lose magnetism at a temperature defined by a Curie temperature by composition adjustment to selectively create a heating region and a non-heating region of the heat generation layer;

a degausser disposed opposite the heat generator and made of a non-magnetic material having an electrical resistivity smaller than an electrical resistivity of the temperature sensitive magnetic body; and a holder contacting and supporting the degausser, an entirety of the holder disposed inboard from a lateral edge of the degausser and outboard from a lateral end of the exciting coil in a longitudinal direction of the degausser.

2. The fixing device according to claim 1, further comprising a shaft to support the heat generator, wherein the holder supports the degausser such that the degausser is disposed opposite the shaft.

3. The fixing device according to claim 2, wherein the holder includes a plate disposed inboard from the lateral edge of the degausser and outboard from the lateral end of the exciting coil in an axial direction of the shaft parallel to the longitudinal direction of the degausser.

4. The fixing device according to claim 2, wherein the shaft includes a flat portion extending in an axial direction of the shaft, and wherein the holder includes a mount tab extending in the axial direction of the shaft and fastened to the flat portion of the shaft with a bolt.

5. The fixing device according to claim 2, wherein the degausser is arcuate.

6. The fixing device according to claim 5, wherein the holder contacts an inner circumferential surface of the degausser.

7. The fixing device according to claim 6, wherein the degausser is disposed opposite an outer circumferential surface of the shaft.

8. The fixing device according to claim 7, wherein the degausser includes an engagement tab disposed at a lateral end of the degausser in an axial direction of the shaft, and wherein the holder includes a notch to engage the engagement tab of the degausser to prevent radial deformation of the degausser.

9. The fixing device according to claim 8, wherein the notch extends inward from an outer circumferential surface of the holder.

10. The fixing device according to claim 8, wherein the holder further includes a projection contacting the inner circumferential surface of the degausser.

11. The fixing device according to claim 8, wherein the degausser further includes a location tab extending from the engagement tab at a right angle.

12. The fixing device according to claim 11, wherein a length of the location tab is smaller than a length of the engagement tab in the longitudinal direction of the degausser, and wherein the engagement tab and the location tab define a reentrant to engage the holder.

13. The fixing device according to claim 1, wherein the heat generation layer of the heat generator is disposed opposite the exciting coil and includes a surface treated with conductive plating.

14. The fixing device according to claim 1, wherein the heat generation layer of the heat generator is made of copper.

15. The fixing device according to claim 1, wherein the temperature sensitive magnetic body of the heat generator is formed in one of a roller, a film, and an endless belt.

16. The fixing device according to claim 1, wherein the degausser is disposed opposite the exciting coil with an interval in a range of from about 4.2 mm to about 8.2 mm.

17. The fixing device according to claim 1, wherein the heat generator is formed in a roller to come into contact with a toner image on a recording medium to heat the toner image on the recording medium.

18. The fixing device according to claim 1, further comprising a fixing belt to come into contact with a toner image on a recording medium to heat the toner image on the recording medium, wherein the heat generator is formed in a roller, over which the fixing belt is looped, to heat the fixing belt.

19. An image forming apparatus comprising the fixing device according to claim 1.

20. A fixing device comprising:

an exciting coil to generate a magnetic flux;

a heat generator disposed opposite the exciting coil and including:

a heat generation layer disposed opposite the exciting coil to generate heat by the magnetic flux from the exciting coil; and a temperature sensitive magnetic body disposed opposite the exciting coil via the heat generation layer, the temperature sensitive magnetic body to obtain and lose magnetism at a temperature defined by a Curie temperature by composition adjustment to selectively create a heating region and a non-heating region of the heat generation layer;

a shaft to support the heat generator;

a degausser disposed opposite the heat generator and made of a non-magnetic material having an electrical resistivity smaller than an electrical resistivity of the temperature sensitive magnetic body; and a holder contacting and supporting the degausser, the holder disposed inboard from a lateral edge of the degausser and outboard from a lateral end of the exciting coil in a longitudinal direction of the degausser, wherein the holder supports the degausser such that the degausser is disposed opposite the shaft, wherein the shaft includes a flat portion extending in an axial direction of the shaft, and wherein the holder includes a mount tab extending in the axial direction of the shaft and fastened to the flat portion of the shaft.

* * * * *